US006250031B1

(12) United States Patent
Metelli

(10) Patent No.: US 6,250,031 B1
(45) Date of Patent: Jun. 26, 2001

(54) DOUBLE SLOPE BEAM IN TWO HALVES

(76) Inventor: Luigi Metelli, Via Fabrichetta 1, Cologne (Brescia) (IT)

( * ) Notice: Subject to any disclaimer, the term of this patent is extended or adjusted under 35 U.S.C. 154(b) by 0 days.

(21) Appl. No.: 09/294,585

(22) Filed: Apr. 20, 1999

(51) Int. Cl.[7] ..... E04C 5/08; E04C 5/12; E04C 3/26; E04B 1/41

(52) U.S. Cl. ..... 52/223.11; 52/223.9; 52/127.12; 52/250; 52/582.1; 52/583.1; 52/601; 52/691; 52/726.1; 52/726.2

(58) Field of Search ..... 52/223.9, 223.11, 52/726.1, 724.1, 582.1, 250, 251, 127.12, 583.1, 601, 691, 726.2

(56) References Cited

U.S. PATENT DOCUMENTS 3,465,484 * 9/1969 Zaldastani et al. ..... 52/250 X
4,612,751 * 9/1986 Gloppen et al. ..... 52/724.1
4,781,006 * 11/1988 Haynes ..... 52/583.1

* cited by examiner

*Primary Examiner*—Christopher T. Kent
(74) *Attorney, Agent, or Firm*—McGlew and Tuttle, P.C.

(57) ABSTRACT

The present invention concerns a double slope beam in vibrated or pre-compressed reinforced concrete, composed of two complementary halves or semi-beams (10) each with a reinforcing framework and with adjoining parts which are destined to be mated together incorporating some steel connecting plates (12, 13) that are anchored in the reinforcing framework by means of tie-rods. The two semi-beams are joined together by bolts at the time of forming the whole beam.

12 Claims, 4 Drawing Sheets

DOUBLE SLOPE BEAM IN TWO HALVES

FIELD OF THE INVENTION

The present invention concerns double slope beams in vibrated or pre-compressed reinforced concrete.

BACKGROUND OF THE INVENTION

These beams have always been made in one piece, with an uninterrupted metal reinforcement, but not without disadvantages and inconveniences. The beams can be of various lengths and sections and with different slopes. Their construction in one piece requires formwork which is particularly bulky, not only because of its length but also because of its height, especially for beams with a steep slope. The handling of these beams is extremely difficult due to their dimensions and their relative weight. Then the transport of these whole beams, in particular those which are long, always presents problems, beyond being very expensive, especially when it is necessary to resort to exceptional transport and/or there is a need to travel on narrow or mountainous roads All these difficulties mean that up to now beams have been constructed below a certain dimension, in order not to aggravate the problems of bulk, transport, etc., even if the demand for certain installations would be for longer beams.

On the other hand, a simple subdivision of the said beams into two parts would make the handling and transporting simpler, but would bring with it problems of joining the two parts and of maintaining the strength and static nature of the beams when in use and under load.

SUMMARY AND OBJECTS OF THE INVENTION

The present invention however, concerns the supply of a double slope beam, of the above mentioned type, constructed of two complementary halves, while at the same time positively solving the problems of the reinforcing and joining of the two halves so that the complete beam results in having strength and static nature characteristics at least comparable, if not actually superior, to those of a one piece beam.

The following are among the advantages that can be derived from this invention:

- smaller dimensions, at least in height, of the formwork for the two halves of the beam in that they can be made flat, on the ground, and not in the sloping position;
- greater simplicity of casting, as this is carried out at lower levels;
- greater ease of handling due to the lower weight of each component half;
- greater ease of transporting, even in difficult conditions, given the reduced length of each component half and the possibility of using standard transport trucks avoiding the need for exceptional transportation;
- this results in a containment of construction and transport costs, and having solved the problem of transportation;
- the possibility of constructing beams of a longer length than with the noted technique and with slopes of between P10 and P50.

These advantages are obtained with a beam in vibrated or pre-compressed reinforced concrete, made up of two complementary opposing halves, whose mating parts incorporate steel joining plates, which are anchored in the reinforcing by means of tie-rods and which are joined together by means of bolts at the moment of the two halves coming together to form a whole beam.

BRIEF DESCRIPTION OF THE DRAWINGS

Greater detail can be found throughout the following description with reference to the attached drawings, which must be seen as indicative and not definitive, in which.

The double slope beam as conceived in this invention is made up of two complementary, and symmetrical halves, or semi-beams (10), which are joined together on a median plane and which can be constructed of vibrated or pre-compressed concrete.

DESCRIPTION OF THE PREFERRED EMBODIMENT

Figure 1:
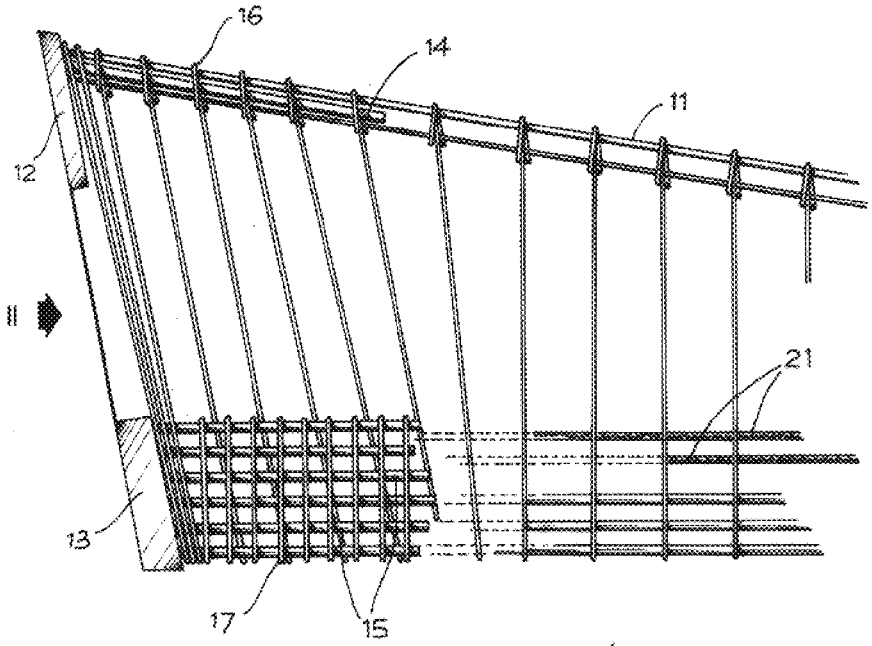
FIG. 1 shows a view of the metal reinforcing complete with the connecting plates for a beam half, the reinforcing for the other half being a mirror image of this one.

Each semi-beam (10) is produced by starting with its own ordinary reinforcing frame (11)—see FIG. 1—with the adding of two steel connecting plates (12, 13), to the part which will be the larger end of the semi-beam which is destined to be connected to the mating end of the other semi-beam.

Firstly the connecting plate (12) is placed in the upper part and anchored to the ordinary reinforcing frame (11) by means of a series of steel tie-rods (14). The other connecting plate (13) is placed in the lower part and also this is anchored to the ordinary reinforcing frame (11) with a number of tie-rods (15).

Considering that in the assembled beam, the upper plates (12) of the two joined semi-beams are under compression, while the lower plates (13) are under tensile stress, the lower plates (13) must be of considerably thicker than those of the upper plates (12) and anchored to the reinforcing (11) by a greater number of tie-rods (15).

The tie-rods (14, 15) of the first and second plates extend for at least a certain length of the ordinary reinforcing (11) and are tied to this by means of stirrups (16) and (17) respectively.

Figure 3:
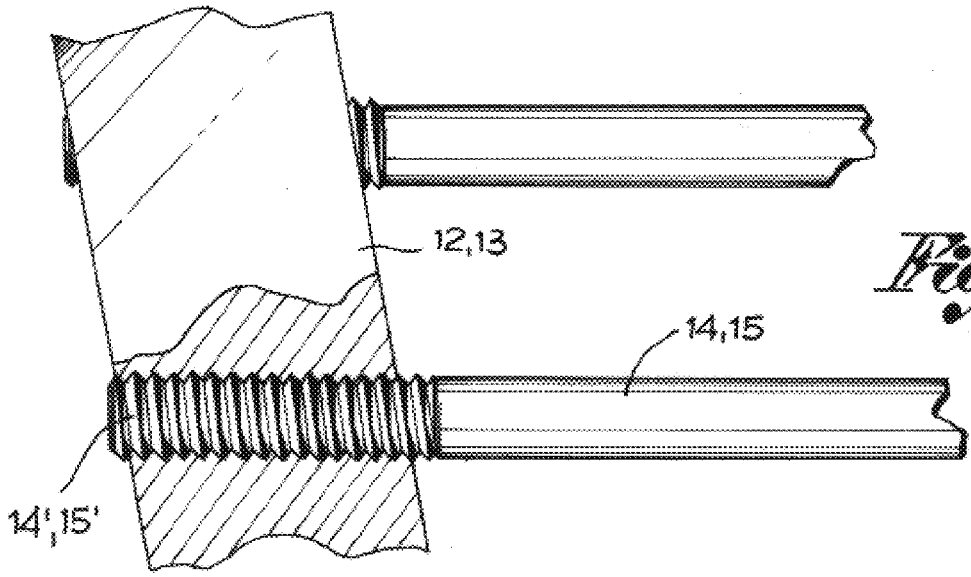
FIG. 3 shows the fixing, with a sectioning, for the screwing in of each steel tie-rod into the connecting plate.

For fixing to the respective plates (12) or (13), each steel tie-rod (14) or (15) can have a portion threaded at the end ($14^1$, $15^1$) which is screwed into the corresponding threaded hole in the connecting plates, as shown in FIG. 3. Preferably, the thread portion ($14^1$) and ($15_1$) of each tie-rod is obtained through a rolling process to avoid cutting the fibre of the material and not reducing its strength.

Figure 4:
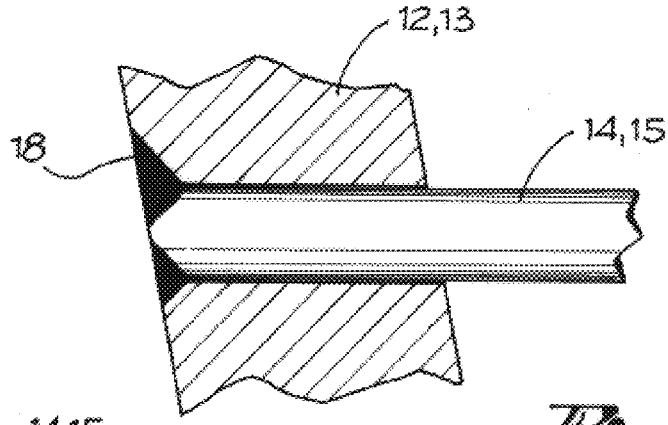
FIGS. 4 and 5 show sectioned views, as in FIG. 3, of two other methods of fixing the steel tie-rods in the connecting plates.
Figure 5:
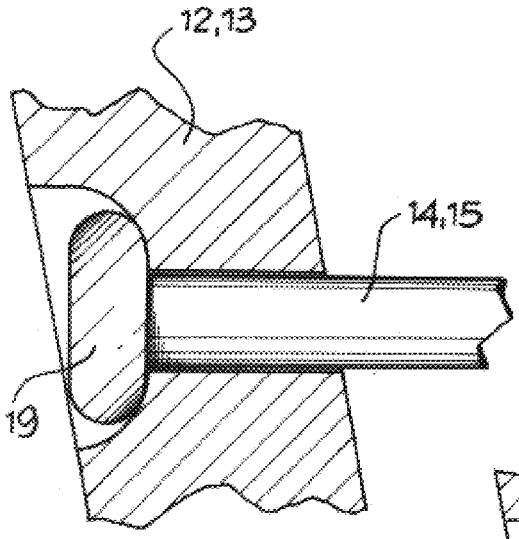

Alternatively, the ends of each tie-rod (14, 15) can be inserted in the hole of the respective connecting plate and fixed by means of welding (18) as shown in FIG. 4. Or also, the ends of each tie-rod (14, 15) can be inserted in a hole of the respective connecting plate and fixed by means of heading (19), as shown in FIG. 5.

Figure 2:
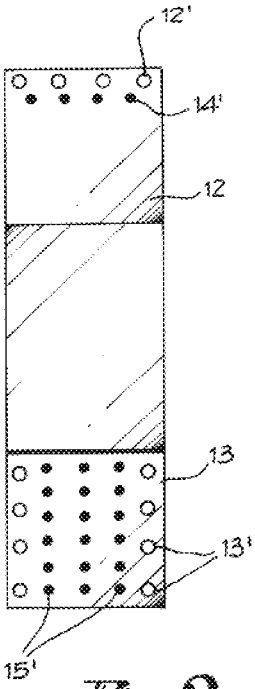
FIG. 2 shows a front view of the reinforcing in the direction of arrow II in FIG. 1.

The connecting plates (12, 13) of each semi-beam has holes to permit there being joined, by means of bolts (20), to the corresponding plate on the opposing semi-beam. The upper plate (12) has some holes ($12^1$) positioned along the upper edge and the lower plate (13) has some holes ($13^1$) along the vertical two sides—see FIG. 2—.

Figure 6:
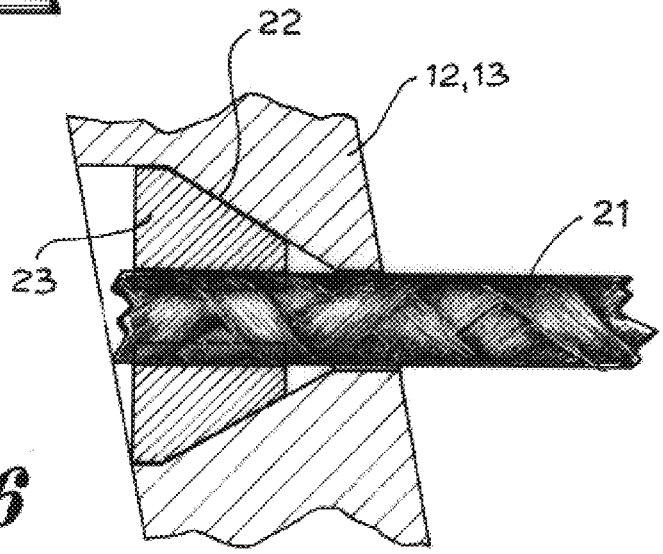
FIG. 6 shows, in section, a system for fixing the cables to the connecting plates when each half of the beam is produced in pre-compressed concrete.

The above described tie-rods (14, 15) can be sufficient for anchoring the connecting plates (12, 13) when the semi-beams (10) are made of vibrated concrete. When the semi-beams (10) are produced using pre-compressed concrete then at least the lower plate (13) must also be anchored using some tensioning cables (21). These cables, indicated in FIG. 1, can be in addition to or in the place of certain tie-rods (15). The ends these are extended into conical holes (22) in the connecting plate (13) and are held in place by two half cones (23), as shown in FIG. 6.

The reinforcing frame complete with its connecting plates fitted in this way is placed in a formwork for the casting of the semi-beam, maintaining the lower side flat on the ground.

By preference, the two complementary semi-beams (10), even if they are disconnected, should be cast in line with each other with a stand or other reference piece located in between to ensure the mating of the corresponding bolt holes in the connecting plates for when the two halves are assembled and also as they define the inclination.

Figure 7:
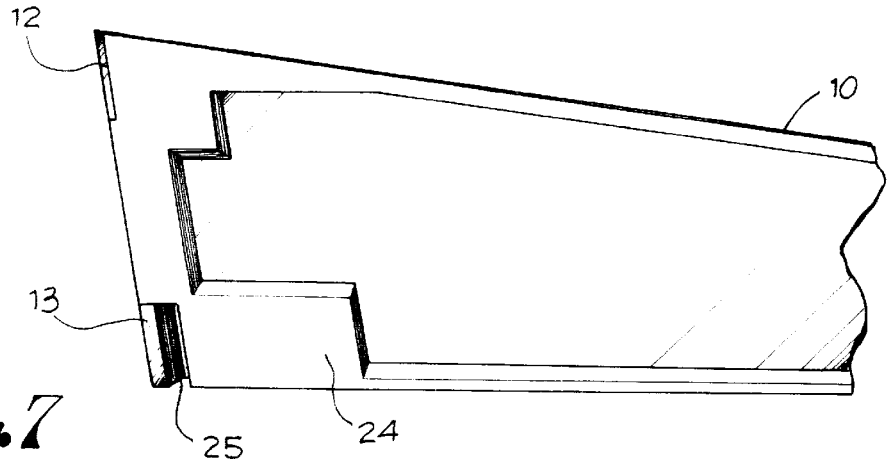
FIG. 7 shows a side projection of a finished half beam.

In the resulting semi-beam, the connecting plates (12, 13) are at the larger end and are firmly anchored in the body of the beam. On the sides of the body of the beams there are some thicker portions (24) corresponding to the connecting plate anchoring tie-rods—see FIG. 7—. Also on the sides of the semi-beam, just behind the lower connecting plate (13) recesses(25) are created during the casting using removable formers, to allow access to the lateral holes ($13^1$) to permit the insertion and tightening of the connecting bolts when the semi-beams are joined for use.

Figure 8:
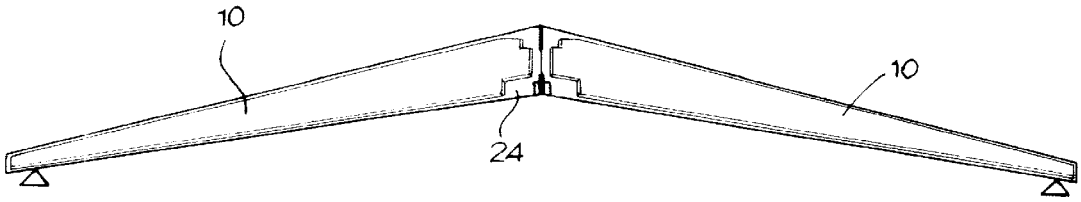
FIG. 8 shows the complete beam made up of its two complementary parts.
Figure 9:
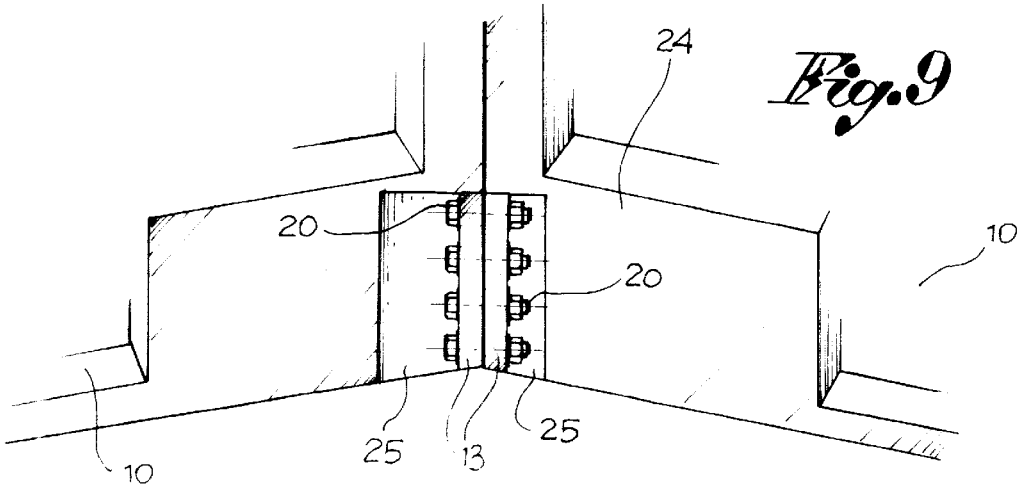
FIG. 9 shows a detailed view of the fixing of the two halves of the beam.
Figure 10:
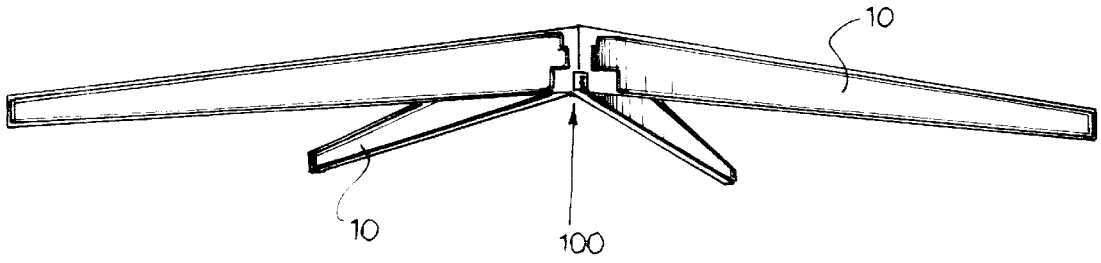
FIGS. 10 and 10*a* are view showing one way of assemblying a plurality of bean halve to form a dome-like roof.
Figure 10A:
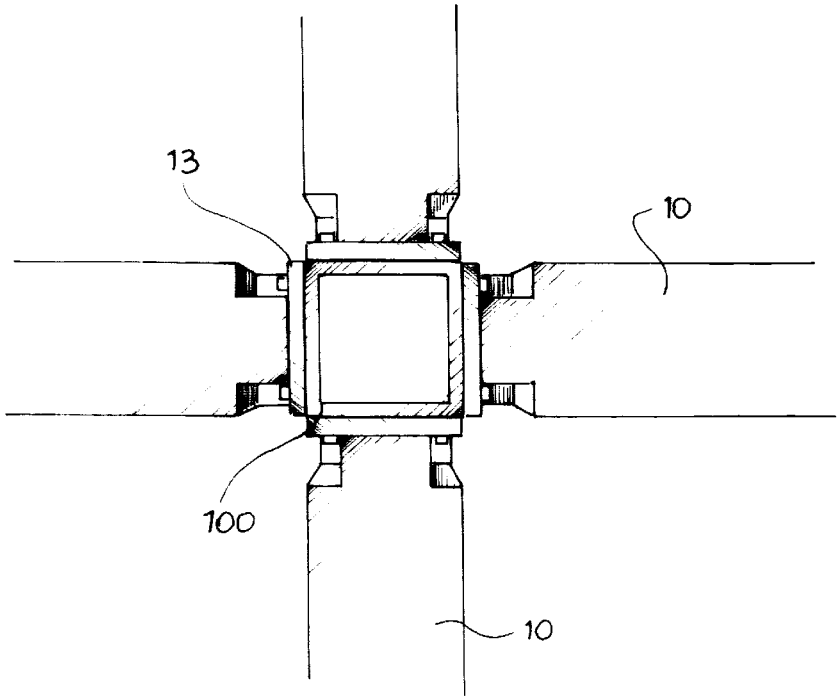

The semi-beams can be disconnected for ease of handling and transport. These are joined at the time of putting the beam into use by simply securing them together, easily but securely, utilising the bolts (20) fitted into holes ($12^1$, $13^1$) in the connecting plates, as shown in FIG. 8 and in the details in FIG. 9. In FIGS. 10 and 10*a* an assembly is shown wherein at least four semi-beams 10 are fixed to a central quadrilater body 100 so as to form a dome-like roof.

What is claimed is:

1. A double slope beam in vibrated or pre-compressed reinforced concrete, the beam comprising:

a first half or semi-beam; and a second half or semi-beam, said first half or semi-beam and said second half or semi-beam forming two complementary halves or semi-beams, each half including a reinforcing framework and adjoining parts for mating together and including tie rods, bolts, and steel connecting plates anchored in said reinforcing framework by said tie-rods, said tie rods being joined together using said bolts at the time of assembling the whole beam.

2. A beam in accordance with claim 1, wherein said reinforcing framework of each semi-beam has a larger end for joining together with another semi-beam, said connecting plates including an upper connecting plate anchored by a series of said steel tie-rods and a lower connecting plate anchored by another series of said steel tie-rods, with said tie-rods for said upper and said lower plates being fixed to the reinforcing framework by stirrups, said tie-rods for said lower plate being greater in number than said tie-rods for the upper plate.

3. A beam in accordance with claim 2, further comprising cables, wherein for the production of the beams in pre-compressed concrete, said cables are connected at least to said lower plate.

4. A beam in accordance with claim 1, wherein each tie rod has a threaded end and is fixed in a respective one of said connecting plates by said threaded end being secured in a threaded hole in said respective one of said connecting plates.

5. A beam in accordance with claim 2, wherein each tie rod has a threaded end and is fixed in a respective one of said upper plate and said lower plate by said threaded end being secured in a threaded hole in the respective plate.

6. A beam in accordance with claim 1, wherein each tie rod is fixed in a respective one of said connecting plates by one of its ends being welded into a hole in the plate.

7. A beam in accordance with claim 2, wherein each tie rod is fixed in a respective one a hole in the plate.

8. A beam in accordance with claim 1, wherein each of said plates has a hole for receiving a tie rod head end and each tie rod has a head end and is fixed in a respective one of said connecting plates by said head end being retained in said hole.

9. A beam in accordance with claim 3, wherein each cable has an end fixed with two locking half-cones in a conical hole in a respective one of said connecting plates.

10. A beam in accordance with claim 1, further comprising: two complementary semi-beam connecting bolts, wherein each of said connecting plates has a number of holes for accommodating said two complementary semi-beam connecting bolts.

11. A beam in accordance with claim 7, further comprising: two complementary semi-beam connecting bolts, wherein each of said connecting plates has a number of holes for accommodating said two complementary semi-beam connecting bolts, wherein at least on a side of said lower plate, of each of said semi-beams, gaps or recesses are provided for access to the holes for the bolts.

12. A beam in accordance with claim 1, wherein each semi-beam has thickened portions on sides at a level of the respective connecting plate anchoring tie-rods.

* * * * *